US007663326B2

(12) United States Patent
Santo et al.

(10) Patent No.: US 7,663,326 B2
(45) Date of Patent: Feb. 16, 2010

(54) TEMPERATURE DEPENDANT LED CURRENT CONTROLLER

(75) Inventors: Hendrik Santo, San Jose, CA (US); Gurjit Thandi, San Jose, CA (US); Dilip S, Saratoga, CA (US); Kien Vi, Palo Alto, CA (US)

(73) Assignee: mSilica Incorporated, Santa Clara, CA (US)

( * ) Notice: Subject to any disclaimer, the term of this patent is extended or adjusted under 35 U.S.C. 154(b) by 74 days.

(21) Appl. No.: 11/805,525

(22) Filed: May 22, 2007

(65) Prior Publication Data

US 2008/0290804 A1 Nov. 27, 2008

(51) Int. Cl.
*H05B 37/02* (2006.01)

(52) U.S. Cl. ..... 315/309; 315/157

(58) Field of Classification Search ..... 315/291, 315/307–309, 157–158, 112, 168; 345/82, 345/102, 101, 106

See application file for complete search history.

(56) References Cited

U.S. PATENT DOCUMENTS 5,642,252 A 6/1997 Sakamoto et al.
5,661,645 A * 8/1997 Hochstein ..... 363/89
6,161,910 A 12/2000 Reisenauer et al.
6,362,578 B1 * 3/2002 Swanson et al. ..... 315/307
7,262,752 B2 * 8/2007 Weindorf ..... 345/82
2002/0130786 A1 9/2002 Weindorf

OTHER PUBLICATIONS

International Search Report for PCT/US08/64265, mailed Aug. 8, 2008.

* cited by examiner

*Primary Examiner*—Douglas W Owens
*Assistant Examiner*—Jimmy T Vu
(74) *Attorney, Agent, or Firm*—Turocy & Watson, LLP; Vinay Joshi

(57) ABSTRACT

The present invention provides a controller for regulating current in LEDs in electronic displays. The controller uses temperature sensing diodes to detect changes in the LED ambient temperature. As the LED ambient temperature changes, the forward voltage of the temperature sensing diode decreases. A signal processor adjusts the current passing through the LEDs based on the temperature induced changes in the forward voltage of the temperature sensing diodes. The present invention can reduce costs over the present methods of regulating current in LEDs and may more easily be integrated into a single integrated circuit chip. The temperature sensing may also be implemented outside the integrated circuit chip.

17 Claims, 8 Drawing Sheets

PRIOR ART

PRIOR ART

PRIOR ART

TEMPERATURE DEPENDANT LED CURRENT CONTROLLER

FIELD OF INVENTION

The present invention relates to electronic display technology and particularly to a circuit for regulating the current in the backlight arrays of light emitting diodes (LED) of electronic displays based on the ambient temperature of the LED arrays.

BACKGROUND OF THE INVENTION

Backlights are used to illuminate liquid crystal displays (LCDs). LCDs with backlights are used in small displays for cell phones and personal digital assistants (PDA), as well as in large displays for computer monitors and televisions. Typically, the light source for the backlight includes one or more cold cathode fluorescent lamps (CCFLs). The light source for the backlight can also be an incandescent light bulb, an electroluminescent panel (ELP), or one or more hot cathode fluorescent lamps (HCFLs).

The display industry is enthusiastically pursuing the use of LEDs as the light source in the backlight technology because CCFLs have many shortcomings: they do not easily ignite in cold temperatures, require adequate idle time to ignite, and require delicate handling. LEDs generally have a higher ratio of light generated to power consumed than the other backlight sources. So, displays with LED backlights consume less power than other displays. LED backlighting has traditionally been used in small, inexpensive LCD panels. However, LED backlighting is becoming more common in large displays such as those used for computers and televisions. In large displays, multiple LEDs are required to provide adequate backlight for the LCD display.

The number of LEDs required for a given display, and the cost to manufacture the display, can be reduced by increasing the amount of light produced by each LED. The amount of light produced by an LED, or luminous intensity, is a function of the current in the LED. As shown in FIG. 1, the luminous intensity of an LED increases with increasing current in the LED. However, there is a limit to how high the intensity of an LED can reliably be increased by increasing the current. This limit is shown as $I_{MAX}$ in FIG. 1. $I_{MAX}$ is generally expressed as the mean operating current. The current may be continuous or discrete, in which case $I_{MAX}$ is the average current calculated by the product of the delta (or difference) between maximum and minimum current and the duty cycle. At currents near or above $I_{MAX}$, there is a high probability that the LED will catastrophically fail. Operating LEDs at such conditions leads to reliability problems in displays and higher repair and warranty costs for display manufacturers. Therefore, display manufacturers generally do not drive LEDs at or above $I_{MAX}$.

One of the challenges facing display manufactures is that $I_{MAX}$ is not constant. As shown in FIG. 2, $I_{MAX}$ 20 is a function of the temperature of the medium surrounding the LEDs, or LED ambient temperature. FIG. 2 shows that $I_{MAX}$ is nearly constant over an ambient temperature range up to the slope transition temperature, $T_{SLP}$ 21. Once the ambient temperature reaches $T_{SLP}$, $I_{MAX}$ decreases with increasing ambient temperature until the ambient temperature reaches $T_{MAX}$. When the ambient temperature reaches $T_{MAX}$ 23, no current can be applied to the LED without a high risk of catastrophic failure. LED manufactures often provide customers with $T_{MAX}$ curves like that in FIG. 2 so that display manufactures can avoid conditions that result in a high probability of LED failure. LED manufactures generally recommend that the LEDs operate in the range below the $T_{MAX}$ curve, the safe operating area.

The LED ambient temperature is largely a function of the environment in which the display is placed. Many display applications, such as in automobiles, are subject to high temperatures and large temperature fluctuations. Therefore, display manufactures are faced with a tradeoff between competing options. Display manufactures may run LEDs at a lower current that is within the safe operating area over a larger temperature range. But this requires more LEDs per display for a given intensity. Or display manufactures can choose to run the LEDs at a higher current but face reliability issues at higher ambient temperatures.

One approach to maintaining LED current below $I_{MAX}$ is to control the LED ambient temperature. If the LED ambient temperature is controlled to less than $T_{SLP}$, then the LED current can safely be maintained constant at or near the maximum value of $I_{MAX}$. This approach has the benefits of allowing the LEDs to run at the maximum safe current and not requiring changes to the current in the LEDs based on changes in the ambient temperature. However, regulating temperature generally requires additional devices to be added to the display. The additional temperature-regulating devices are expensive to manufacture, expensive to operate, bulky and noisy. Because of these limitations, temperature-regulating devices are not generally used in displays to control the LED ambient temperature. Even when temperature-regulating devices, such as heat sinks, are used to control the LED ambient temperature, they may not provide sufficient temperature control to allow the LED current to operate at or near $I_{MAX}$.

Another approach is to maintain the LED current at a value below $I_{SAF}$ 22 at all times, as shown in FIG. 2. At currents below $I_{SAF}$, LEDs have the largest possible safe ambient temperature range. A benefit of this approach is simplicity. An exemplary circuit for maintaining the LED current below $I_{SAF}$ is shown in FIG. 3. In this circuit, the value of the resistor $R_{SET}$ 31 can be determined from values of the input voltage ($V_{SET}$ 32), the forward voltage ($V_F$) of the LEDs 33, and the maximum allowed current $I_{SAF}$. A disadvantage of this approach is that the LEDs 33 are not utilized to their maximum potential. At all LED ambient temperatures below $T_{MAX}$, the current in the LEDs 33 cannot be increased to go outside the safe operating area. Therefore, for a given intensity requirement of a display, more LEDs might be required.

Another approach is to use a negative temperature coefficient resistor and logic to control the current in the LEDs. An example of this approach is shown in FIG. 4. The negative temperature coefficient resistor, $R_{NTC}$ 41, is located so as to be at the same ambient temperature as the LEDs 43. As the LED ambient temperature increases, the resistance of $R_{NTC}$ decreases. HCxThe input voltage, $V_L$ 42, is held relatively constant and is independent of the LED ambient temperature. As the resistance of $R_{NTC}$ decreases, the voltage, $V_N$ 44, decreases. The logic 40 compares $V_N$ to a constant reference set point voltage, $V_S$ 45. In one embodiment, the logic 40 is a three-input operational amplifier. When $V_N$ is greater than $V_S$, the logic drives the current in the LEDs to $V_S/R_{SET}$. When $V_N$ is less than $V_S$, the logic 40 drives the current in the LEDs to $V_N/R_{SET}$. As shown in FIG. 5, the voltages and components of the above circuit are designed so that current in the LEDs is at or near $I_{MAX}$ for all temperatures below $T_{SLP}$ 53. The current curve given by $V_S/R_{SET}$ and the current curve given by $V_N/R_{SET}$ 52 intersects at or near $T_{SLP}$ 53. A disadvantage of this solution is that it requires the use of an expensive negative temperature coefficient resistor 41. Further, the negative temperature coefficient resistor 41 of the above circuit cannot readily be made part of the same integrated circuit as the logic 40.

The present invention solves these problems and provides an ambient temperature-based current controller for LEDs that is inexpensive and manufacturable as a single integrated circuit or on multiple integrated circuit chips.

SUMMARY OF THE INVENTION

The present invention provides a controller for regulating current in LEDs in electronic displays. The controller uses temperature sensing diodes to detect changes in the LED ambient temperature. As the LED ambient temperature changes, the forward voltage of the temperature sensing diode decreases. A signal processor adjusts the current passing through the LEDs based on the temperature induced changes in the forward voltage of the temperature sensing diodes.

BRIEF DESCRIPTION OF THE DRAWINGS

The above and other objects and advantages of the present invention will be apparent upon consideration of the following detailed description, taken in conjunction with the accompanying drawings, in which like reference characters refer to like parts throughout, and in which.

DETAILED DESCRIPTION OF THE INVENTION

Figure 1:
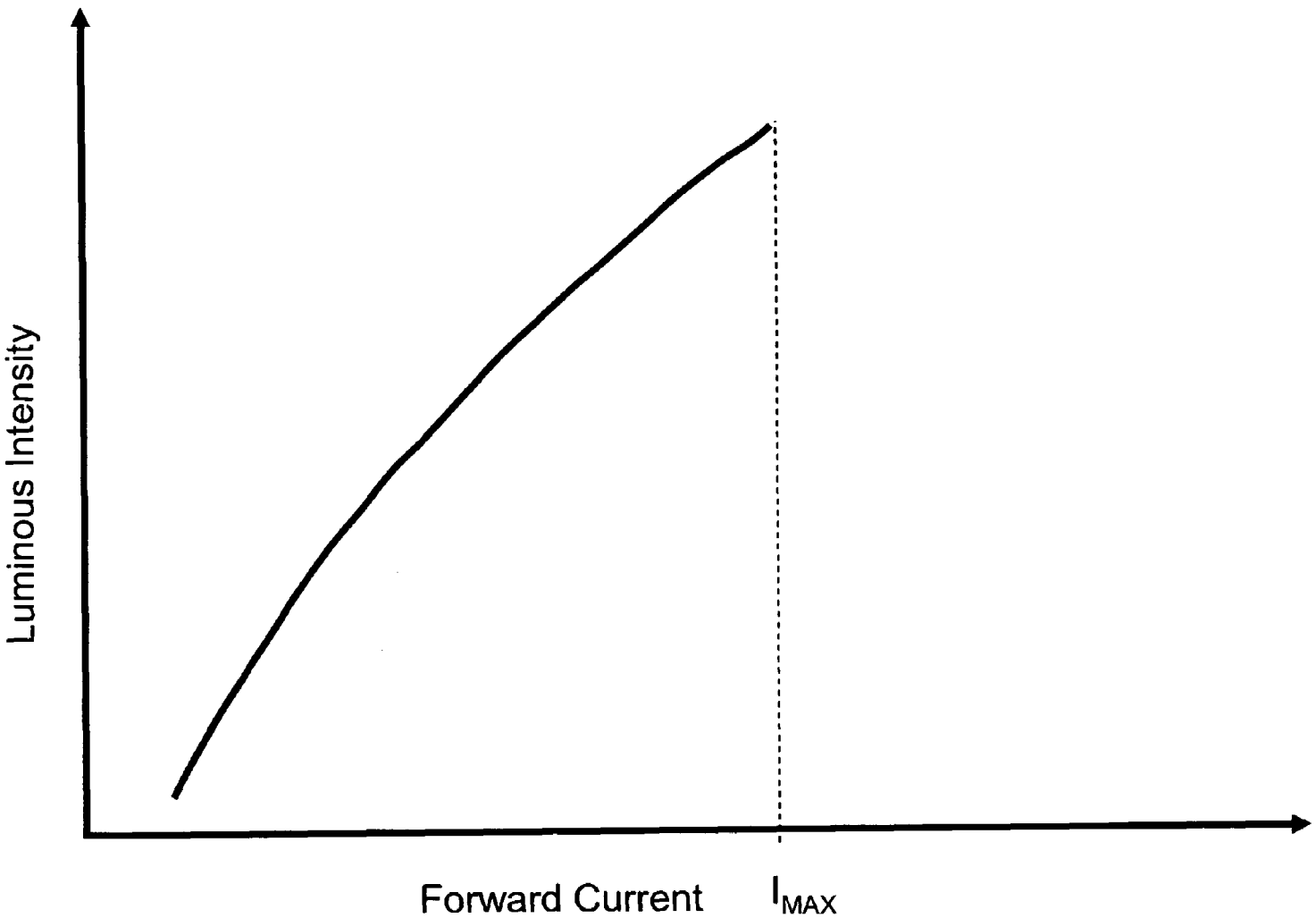
FIG. 1 illustrates the luminous intensity of an LED as a function of the current in the LED.
Figure 2:
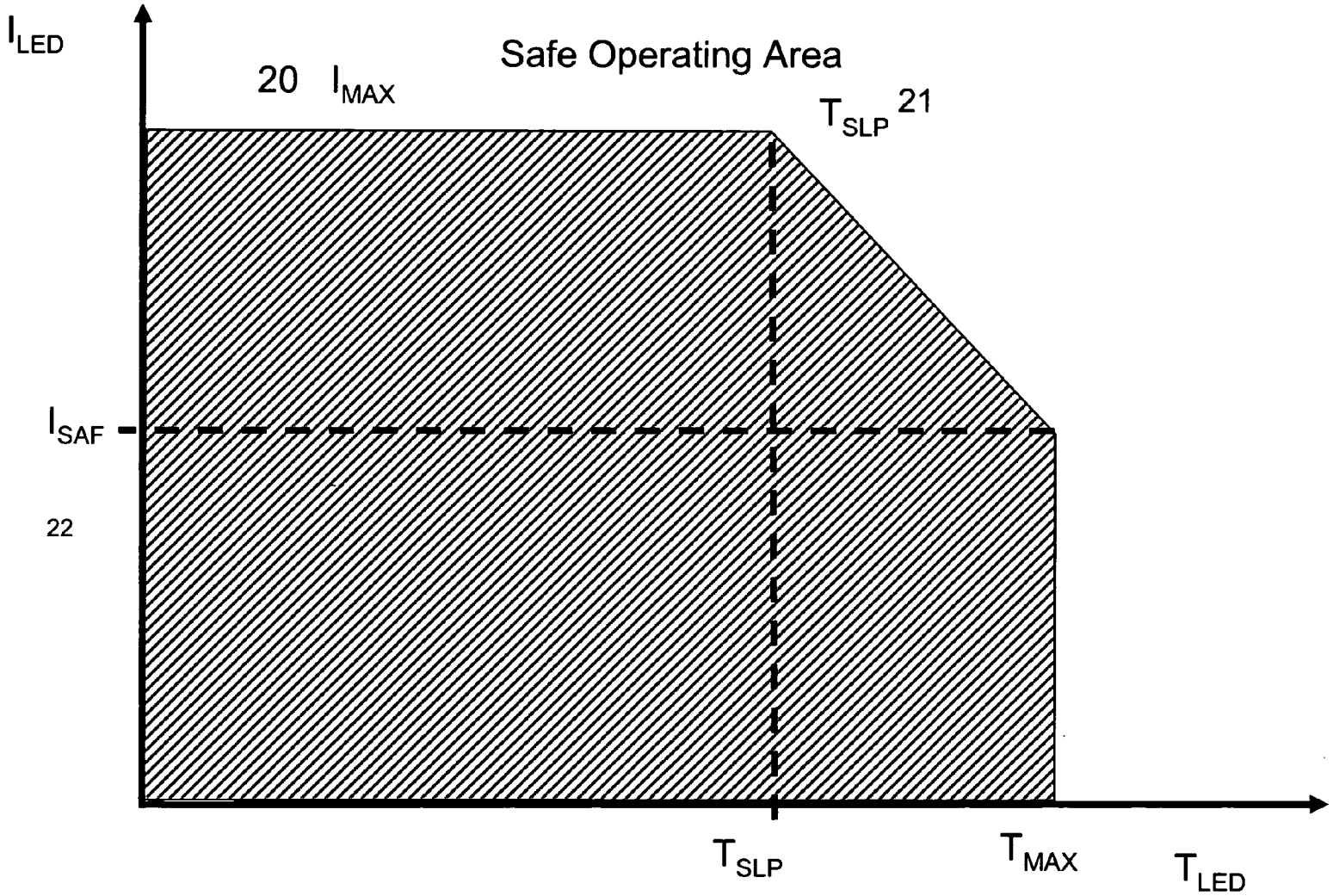
FIG. 2 illustrates a representative curve of the maximum allowable current of an LED.
Figure 3:
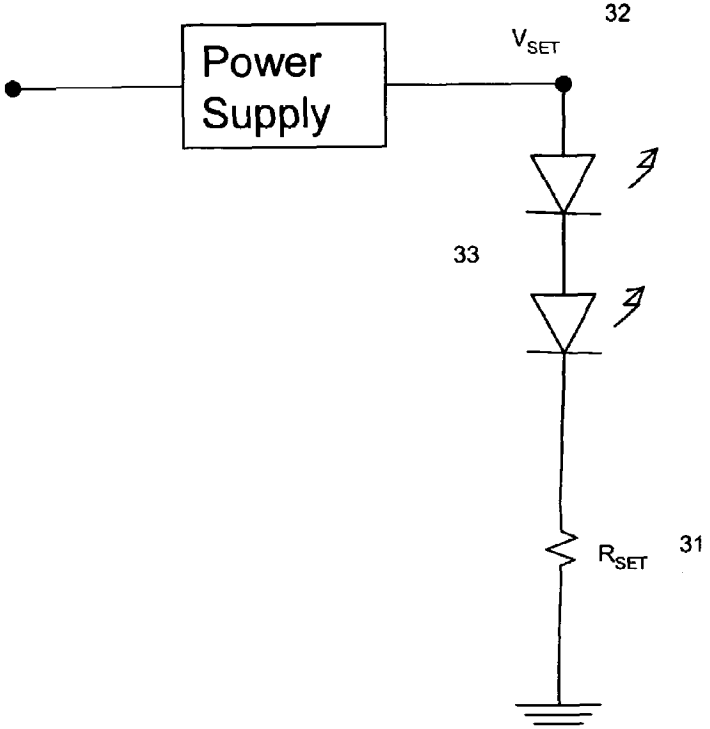
FIG. 3 illustrates a prior art circuit for maintaining the LED current below the maximum allowable current and within the safe operating area.
Figure 4:
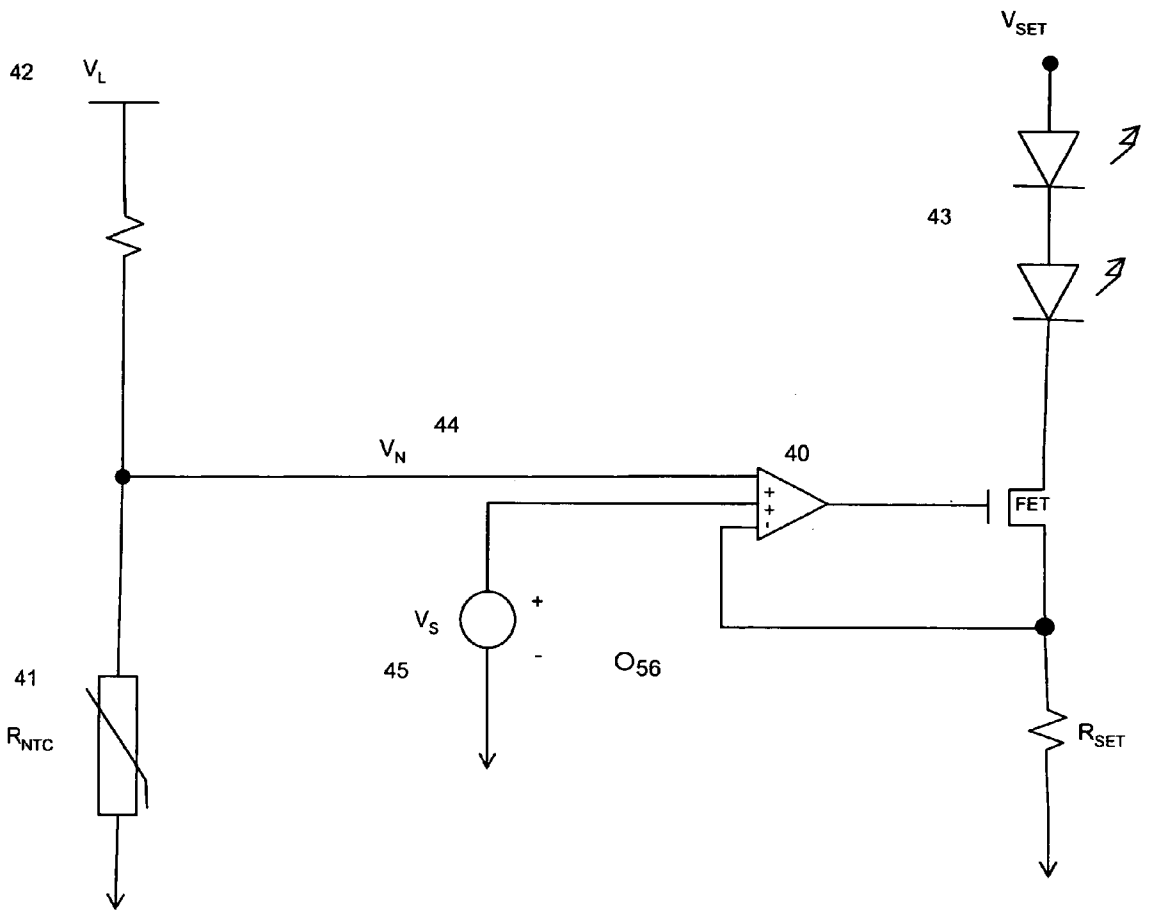
FIG. 4 illustrates a prior art circuit for maintaining the LED current below the maximum allowable current and within the safe operating area.
Figure 5:
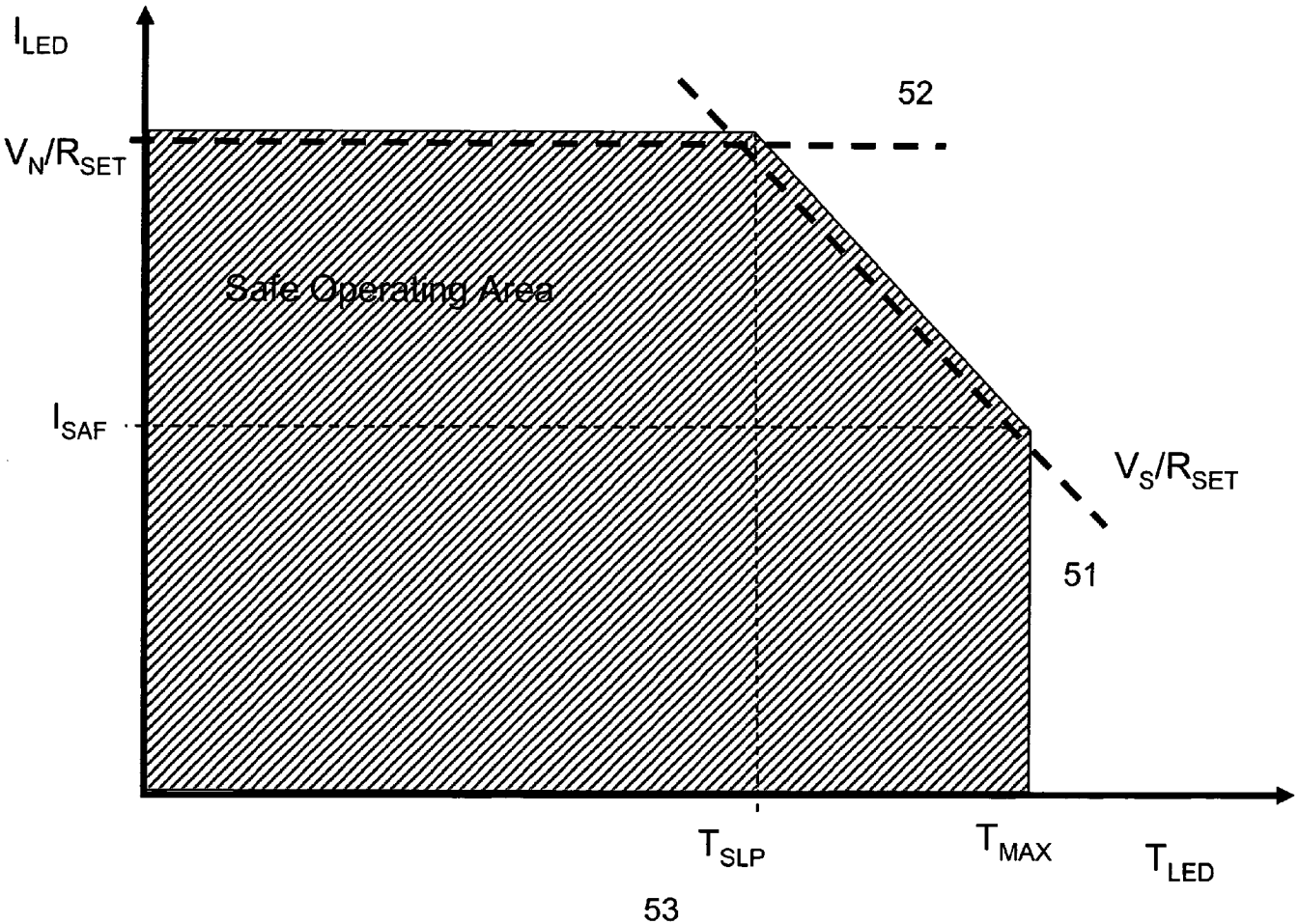
FIG. 5 illustrates the LED current curves for the prior art circuit of FIG. 4.
Figure 6:
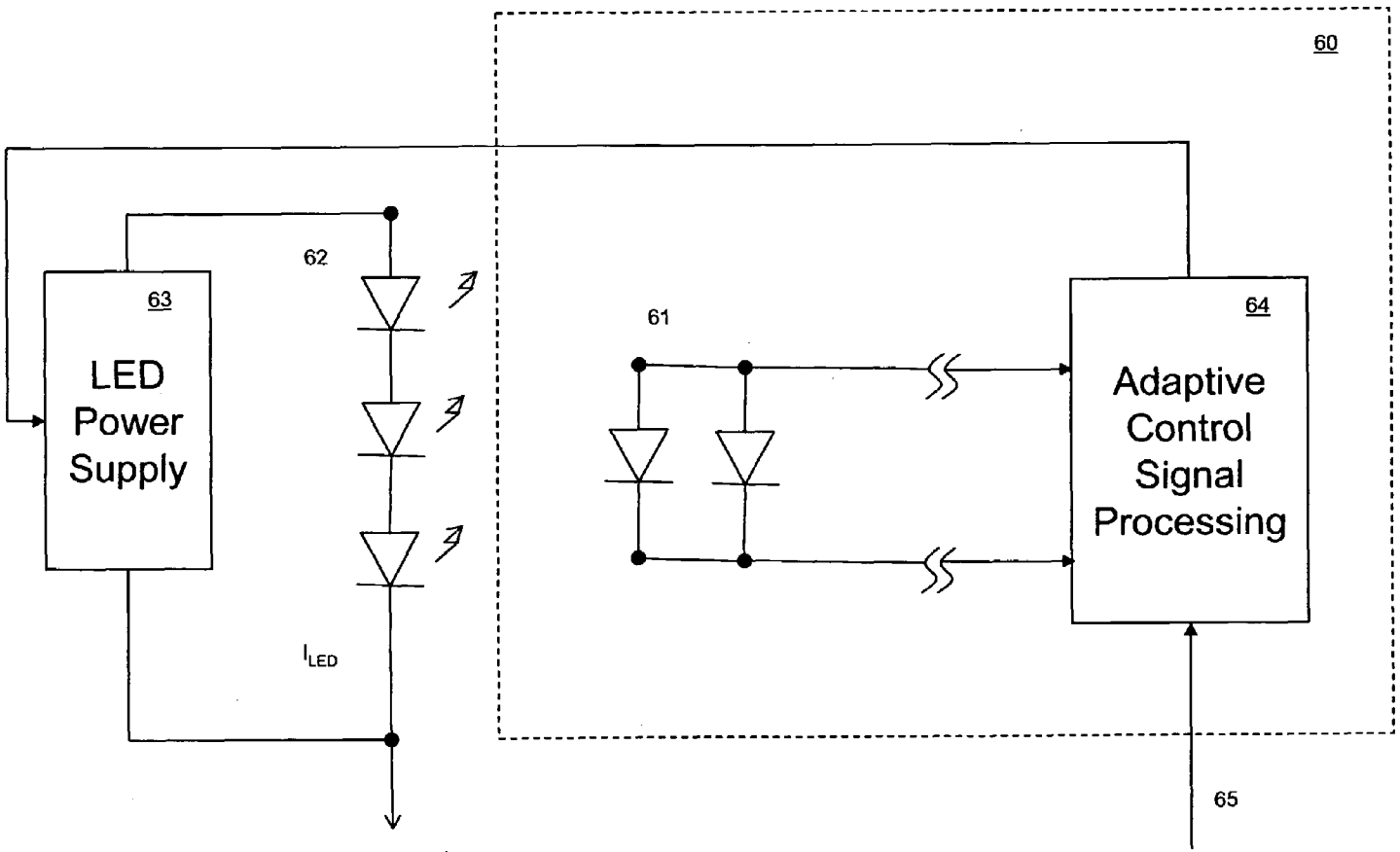
FIG. 6 illustrates an exemplary architecture of the present invention.

FIG. 6 illustrates an exemplary controller 60 for a flat panel display of the present invention for regulating current in an array of one or more LEDs 62. In the example of FIG. 6, an LED power supply 63 powers the array of one or more LEDs 62. The adaptive control signal processing unit 64 is coupled to the LED power supply 63, to one or more temperature sensing diodes 61, and to one or more other input signals 65. The processing unit 64 can include a digital signal processor, an analog signal processor or a hybrid signal processor including analog and digital signal processing components. The processing unit 64 can be implemented in hardware, software or firmware. The processing unit 64 can be implemented using the controller architecture described in the U.S. patent application Ser. No. 11/652,739 entitled "Hybrid Analog and Digital Architecture for Controlling Backlight Light Emitting Diodes of an Electronic Display," which is also assigned to mSilica, the assignee of the present application.

Figure 7:
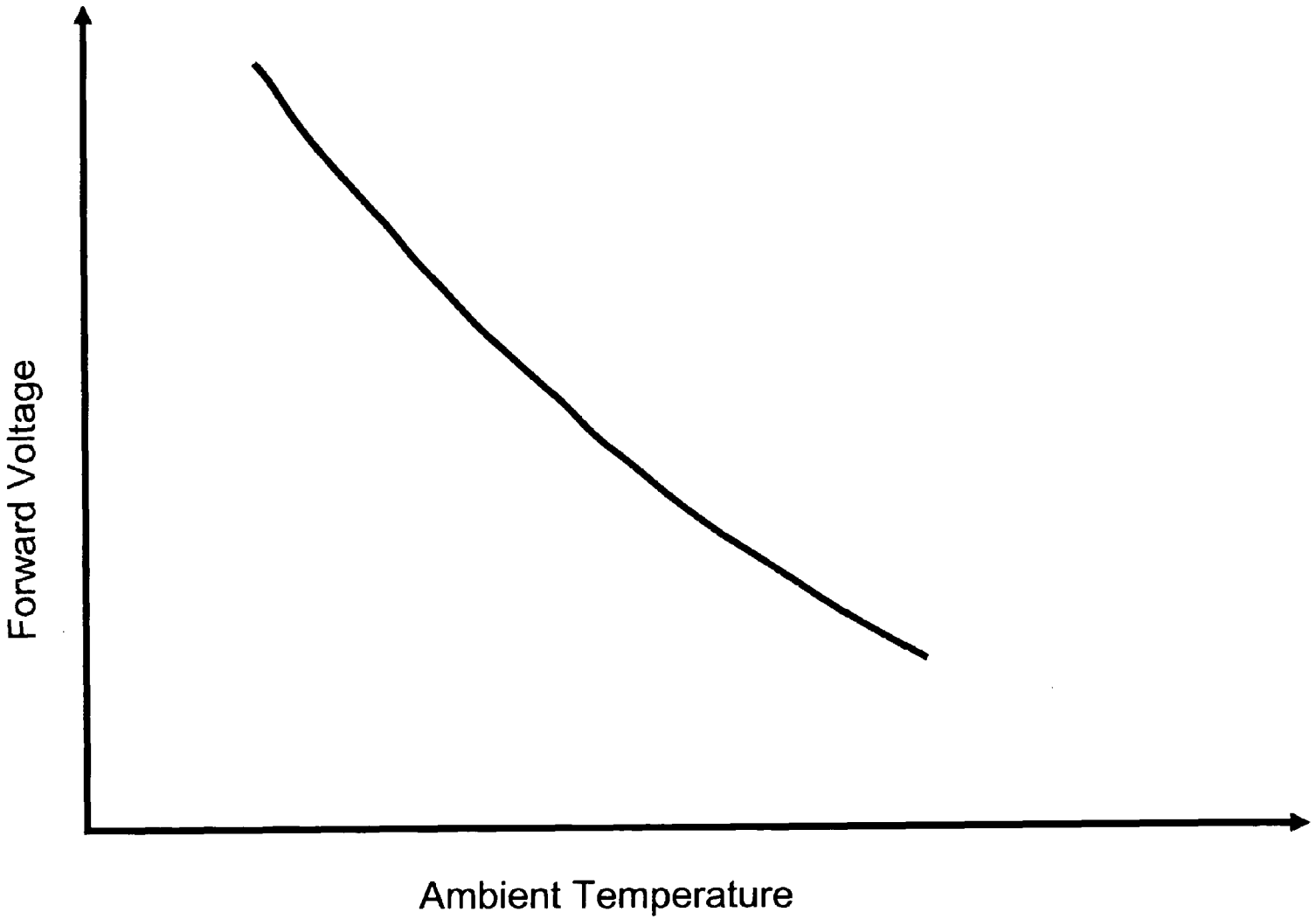
FIG. 7 illustrates an exemplary relationship between diode forward voltage and diode ambient temperature.

The temperature sensing diodes 61 are located in the display so that they are at or near the ambient temperature of the LEDs 62. The temperature sensing diodes 61 and the LEDs 62 can be fabricated from the same material. As the temperature of the sensing diodes 61 increases, the forward voltage of the sensing diodes 61 decreases. An example of the relationship between diode forward voltage and ambient temperature is shown in FIG. 7. A graph like that of FIG. 7 may be provided by the diode manufacturer. The graph and the specifications provided by the manufacturer give correlations between the forward voltage of the diode and the ambient temperature and the operating current of the diode.

The adaptive control signal processing unit 64 is coupled to the sensing diodes 61 so that the adaptive control signal processing unit 64 can detect and respond to changes in the forward voltage of the sensing diodes 61 that result from changes in the LED 62 ambient temperature. Based on the forward voltage of the sensing diodes 61 and one or more input signals 65, the adaptive control signal processing unit 64 regulates the current in the LEDs 62 to stay within the safe operating area of the LEDs.

Figure 8:
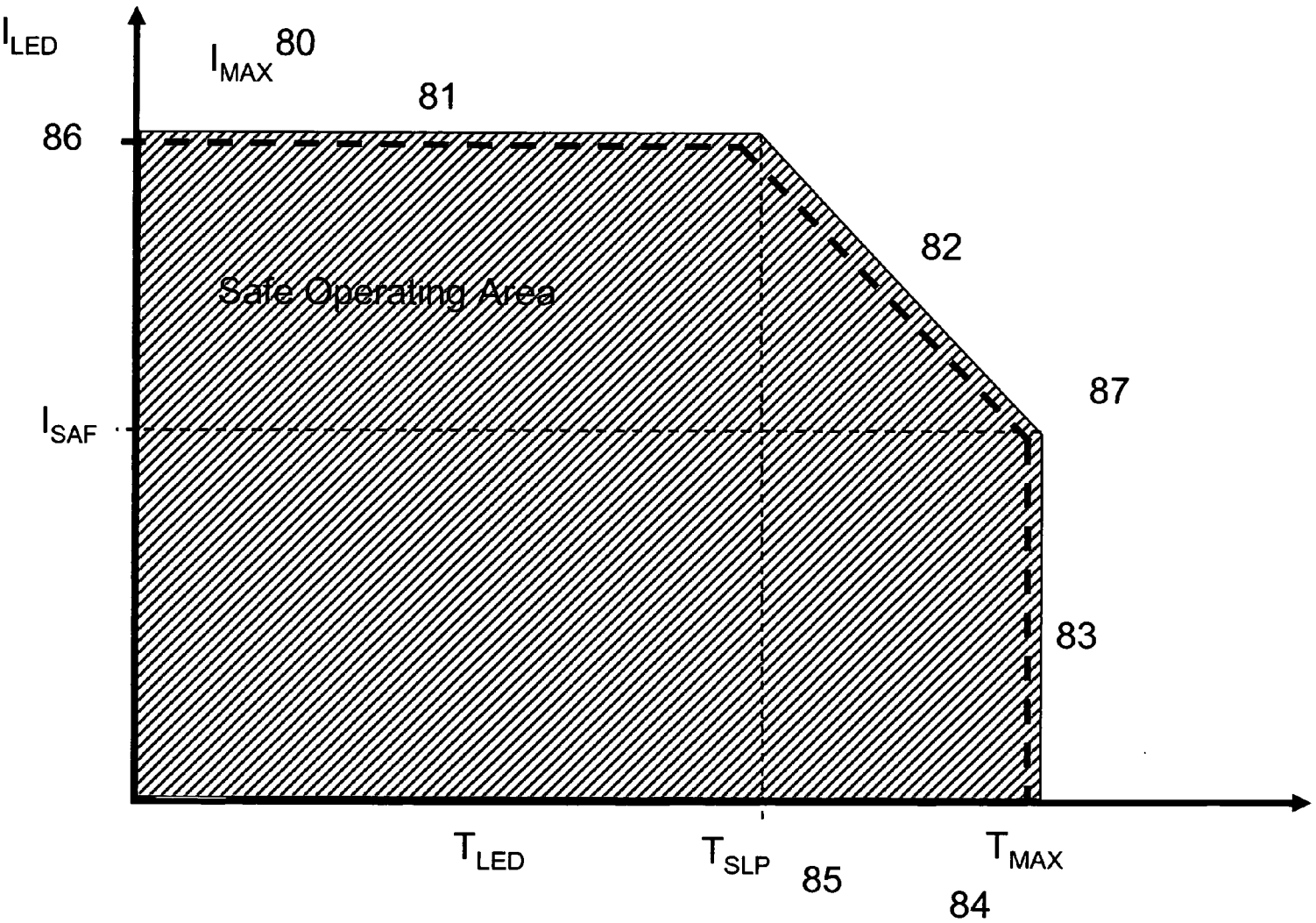
FIG. 8 illustrates the LED current curves for the exemplary architecture of the present invention shown in FIG. 6.

The maximum allowable current as a function of the LED 61 ambient temperature is given by a curve like the $I_{MAX}$ curve 80 in FIG. 8. A curve like that in FIG. 8 is generally provided by the manufacturer of the LEDs 61. Maximum allowable current curves like the curve 80 in FIG. 7 generally have three regions. The first region is the horizontal region 81. In the horizontal region 81, the maximum allowable current, the ceiling current 86, is nearly independent of the ambient temperature. The second region is the sloped region 82. In the sloped region 82, the maximum allowable current for the LEDs decreases with increasing ambient temperature. The intersection of the horizontal region 81 and the sloped region 82 occurs at the slope transition temperature $T_{SLP}$ 85. The third region is the vertical region 83. The vertical region 83 occurs at an ambient temperature $T_{MAX}$ 84 above which any current flow in the LEDs creates a high risk of catastrophic failure.

In the example of FIG. 6, the adaptive control signal processing unit 64 may maintain the current at or near the ceiling current 86 when the ambient temperature is lower than $T_{SLP}$ 85. If the ambient temperature reaches $T_{SLP}$ 85, the adaptive control signal processing unit 64 lowers the current in the LEDs according to the maximum allowable LED current with further ambient temperature increases. At ambient temperatures above $T_{MAX}$, the adaptive control signal processing unit 64 may turn off all current to the LEDs 62. An example of the current curve 87 that the example circuit of FIG. 6 may generate is shown in FIG. 8.

A benefit of the present invention is that it achieves regulation of the current in LEDs at or near the maximum allowable current over a large range of LED ambient temperatures. A further benefit of the present invention is that it does not require a negative temperature coefficient resistor. Eliminating the negative temperature coefficient resistor reduces the cost of the controller and allows integration of all the elements of the controller on a single integrated circuit chip.

In the present invention, current control may be in a continuous mode or a discrete mode such as pulse width modulation (PWM). In a discrete current mode, the current is oscillated between a peak and a minimum current. The percentage of the time that the current is at its peak is known as the duty cycle. The duty cycle times the peak current is the average current. For discrete current modes, currents discussed in the specification refer to average currents.

One of ordinary skill in the art will appreciate that the techniques, structures and methods of the present invention above are exemplary. The present invention can be implemented in various embodiments without deviating from the scope of the invention.

The invention claimed is:

1. A display comprising:

a light emitting element;

a temperature sensing diode for sensing an ambient temperature value; and a controller coupled to said temperature sensing diode for receiving the ambient temperature value and adapted to adjust the current flowing through the light emitting element based on the ambient temperature value; wherein the temperature sensing diode is situated in close proximity of the light emitting element;

the light emitting element includes a light emitting diode; and the controller adjusts the current flowing through the light emitting diode based on a change in the forward voltage of the temperature sensing diode if the ambient temperature value is approximately at or above the slope transition temperature;

the controller maintains the current flowing through the light emitting diode at or near the ceiling current of the light emitting diode when the ambient temperature value is below the slope transition temperature.

2. The display of claim 1, wherein the forward voltage of the temperature sensing diode decreases when the ambient temperature value increases.

3. The display of claim 1, wherein the controller that adjusts the current flowing through the light emitting diode based on a change in the forward voltage of the temperature sensing diode.

4. The display of claim 1, wherein the temperature sensing diode and the controller are located on the same integrated circuit.

5. The display of claim 1, wherein the controller includes a digital signal processor.

6. The display of claim 1, wherein the controller is implemented in hardware, software or firmware.

7. The display of claim 1, further comprising:

the controller maintains the current flowing through the light emitting diode at or near the ceiling current of the light emitting diode when the ambient temperature value is below the slope transition temperature.

8. The display of claim 7, wherein the controller uses a pulse width modulation technique for applying input voltage to the light emitting diode.

9. The display of claim 1, wherein the light emitting diode and the temperature sensing diode are fabricated from the same material.

10. The display of claim 1, wherein the display includes a flat panel display.

11. A display comprising:

a light emitting diode;

a temperature sensing diode for sensing ambient temperature; and a controller including a digital signal processor coupled to said temperature sensing diode; wherein said temperature sensing diode is located in close proximity of the light emitting diode;

said temperature sensing diode for sensing ambient temperature and providing an ambient temperature value to the digital signal processor; and said digital signal processor for adjusting the current flowing through the light emitting diode based on the ambient temperature value; wherein the controller maintains the current flowing through the light emitting diode at or near the ceiling current of the light emitting diode when the ambient temperature value is below the slope transition temperature;

the controller adjusts the current flowing through the light emitting diode based on a change in the forward voltage of the temperature sensing diode if the ambient temperature value is approximately at or above the slope transition temperature.

12. The display of claim 11, wherein the display includes a flat panel display.

13. The display of claim 11, wherein the temperature sensing diode and the digital signal processor are located on the same integrated circuit chip.

14. The display of claim 11, wherein the digital signal processor is implemented in hardware, software or firmware.

15. The display of claim 11, wherein the controller uses a pulse width modulation technique for applying input voltage to the light emitting diode.

16. The display of claim 11, wherein the light emitting diode and the temperature sensing diode are fabricated from the same material.

17. A method for a flat panel display comprising:

using a temperature sensing diode for sensing ambient temperature in close proximity of a light emitting diode; and using a digital signal processor for adjusting the current flowing through the light emitting diode based on the sensed ambient temperature; wherein adjusting the current flowing through the light emitting diode based on a change in the forward voltage of the temperature sensing diode if the ambient temperature value is approximately at or above the slope transition temperature;

maintaining the current flowing through the light emitting diode at or near the ceiling current of the light emitting diode when the ambient temperature value is below the slope transition temperature.

* * * * *